United States Patent [19]

Riedel

[11] 4,279,434

[45] * Jul. 21, 1981

[54] SKI BRAKE

[75] Inventor: Tilo Riedel, Eching, Fed. Rep. of Germany

[73] Assignee: S. A. Etablissements François Salomon & Fils, Annecy, France

[ * ] Notice: The portion of the term of this patent subsequent to Feb. 13, 1996, has been disclaimed.

[21] Appl. No.: 72,626

[22] Filed: Sep. 5, 1979

Related U.S. Application Data

[62] Division of Ser. No. 815,364, Jul. 13, 1977, abandoned.

[30] Foreign Application Priority Data

Jul. 21, 1976 [DE] Fed. Rep. of Germany ..... 2632849

[51] Int. Cl.[3] ..... A63C 7/10

[52] U.S. Cl. ..... 280/605

[58] Field of Search ..... 280/605, 604, 12 AB; 188/5, 8

[56] References Cited

U.S. PATENT DOCUMENTS

| | | | |
|---|---|---|---|
| 4,059,284 | 11/1977 | Schwarz | 280/605 |
| 4,123,083 | 10/1978 | Riedel | 280/605 |
| 4,139,213 | 2/1979 | Riedel | 280/605 |

FOREIGN PATENT DOCUMENTS

| | | | |
|---|---|---|---|
| 2413099 | 10/1975 | Fed. Rep. of Germany | 280/605 |
| 2535552 | 2/1977 | Fed. Rep. of Germany | 280/605 |

*Primary Examiner*—David M. Mitchell

*Attorney, Agent, or Firm*—Karl F. Ross

[57] ABSTRACT

A ski brake has a pair of ski elements flanking the ski and each formed by a pair of wires which in the braking position with the ski element projecting down below the bottom of the ski extend at an angle to each other, and which in the rest position extend parallel to the normal displacement direction of the ski and to each other. One of the legs of each of these elements is pivoted about an axis fixed on the ski and the other is pivoted about an axis which can be moved toward and away from the immovable axis on the ski for swinging of the elements up and down between the brake and rest positions. A spring is provided either in the form of a springy joint between the lower ends of the two legs or as a separate compression spring to urge the legs into the brake position. An actuator is displaceable from a raised or advanced position into a depressed position to move the brake elements into the rest position and is similarly urged into the raised or advanced position by the spring.

10 Claims, 3 Drawing Figures

SKI BRAKE

CROSS REFERENCE TO RELATED APPLICATIONS

This application is a division of my copending application Ser. No. 815,364 filed July 13, 1977 (now abandoned) and in turn relates to my applications Ser. Nos. 666,232 (now abandoned and replaced by Ser. No. 936,596 field Aug. 24, 1978), Ser. No. 678,706 (now U.S. Pat. No. 4,123,083), Ser. No. 707,453 filed July 21, 1976 (now abandoned), Ser. No. 712,957 filed Aug. 9, 1976 (now abandoned), Ser. No. 712,958 (now U.S. Pat. No. 4,138,136) and Ser. No. 781,447 (now U.S. Pat. No. 4,139,213).

FIELD OF THE INVENTION

The present invention relates to a ski brake. More particularly this invention concerns a device for slowing or stopping a ski should it come loose from a skier's boot.

BACKGROUND OF THE INVENTION

As described in my above-mentioned applications a ski brake serves to slow or stop a ski which has broken away from a skier's boot. To this end such a ski brake usually comprises a braking element which during normal use of the ski assumes a rest position that is out of the way and normally parallel to the normal direction of travel of the ski along the snow. When the skier's boot pulls free from the ski, however, the brake element automatically assumes a position transverse to the ski and projecting beyond the lower surface thereof. Thus should the tie connecting the skier's boot to the ski break, a not uncommon circumstance, the ski nonetheless will be prevented from running freely down the slope where it could cause grave injury.

The principal difficulty with most of the prior-art ski brakes is that they are relatively complex. Thus they add considerably to the cost of the skier's equipment, and in addition their complexity makes them much more failure prone than is acceptable. It is essential that the ski brake function every time it is needed, and further the ski brake should not add so much to the cost of the equipment that the skier will do without it, thereby passing up a commendable safety device.

OBJECTS OF THE INVENTION

It is therefore an object of the present invention to provide an improved ski brake.

Another object is to provide such a brake which is extremely simple in construction.

A further object is the provision of a ski brake which functions automatically and surely every time it is needed, yet which can be built at relatively low cost.

SUMMARY OF THE INVENTION

These objects are attained according to the present invention in a ski brake which is used on a ski having a snow-engaging lower surface and a boot-carrying upper surface. The ski brake has a pivot on the ski defining an immovable pivot axis which is fixed relative to the ski and which extends generally parallel to the upper and lower surfaces of the ski and transverse to the normal forward direction of travel of the ski along the ground or snow. A guide is also provided on the ski which defines a movable pivot axis generally parallel to and spaced in the ski travel direction from the immovable pivot axis and displaceable in the travel direction between an unactuated position relatively far from the immovable pivot axis and an actuated position relatively close thereto. The brake element has a guided leg which in turn has one end pivoted in the guide at the movable pivot axis and a pivot leg which has one end pivoted in the pivot about the immovable pivot axis. These legs have opposite joined-together other ends and the brake element itself is displaceable between a braking position with the movable axis in the unactuated position and the legs extending at an acute angle to each other transverse to the travel direction and downwardly below the lower surface of the ski and a rest position with the legs extending generally parallel to the direction and lying above the lower ski surface. Means is provided including an actuator connected to one of the legs of the brake elements and displaceable on the ski between an advanced position and a depressed position spaced from the advanced position for displacing the braking element from the rest into the braking position on displacement of the actuator from the advanced into the depressed position. Spring means is connected to the element for urging it into the braking position, for urging the actuator into the advanced position, and for urging the movable pivot axis into the unactuated position.

In accordance with further features of this invention the ski brake has two such brake elements each of whose legs are formed of spring-steel wire. The spring means may be formed as a unitary elbow or loop at the other ends of the legs. Alternately these other ends can be pivoted together and a compression spring can be provided to urge the arrangement into the unactuated position. A resilient body may be molded over the legs at their other ends to further constitute spring means.

The guided leg according to this invention has a bent over other end which is received in the guide and which itself defines the movable pivot axis. The guide can either be an element pivotal about an axis on the ski so that the movable pivot axis therefor moves angularly in an arcuate path centered on this lever axis or the guide can be formed with or form with the ski a slot extending in the ski travel direction and having ends defining the actuated and unactuated positions of the movable axis.

According to another feature of this invention the movable pivot axis is defined by the edge of a mounting plate for the ski brake and constituting the guide. When moved from the braking to the rest position the guided leg slides over the edge of the guide so that in effect the movable pivot axis is movable relative to the guided leg, this edge therefore constituting a pivot fulcrum for the guided leg.

It is also within the scope of this invention to bend over the other end of the guided leg and receive it in a round snug recess constituting the guide and formed in the side of a toe or heel boot clamp. This boot clamp is displaceable longitudinally so that it itself constitutes the actuator. Since the boot clamp is invariably provided with a spring which is stressed or compressed when the boot is fitted to the ski, the boot clamp will inherently spring forward or backward depending on whether it is the toe or heel clamp when the boot is released so as to move the recess and displace the brake element into the braking position.

The ski brake according to further features of this invention has two such brake elements which flank the ski and move jointly from the rest to the brake position.

To this end one or the other leg of each of the brake elements is formed integrally with the corresponding leg of the other element by means of a projection and a transverse bight portion constituting the actuator.

Thus in accordance with the present invention an extremely inexpensive and simple ski brake is provided. The biasing of the various forces within the wire constituting the brake element ensures that the device will always function. At the same time any lateral shocks or the like will be automatically damped by the ski brake which is prestressed when in the rest position. In fact this prestressing makes the ski brake extremely rigid in the rest position so that the likelihood of it being damaged or bent out of shape is greatly reduced.

The novel features which are considered as characteristic for the invention are set forth in particular in the appended claims. The invention itself, however, both as to its construction and its method of operation, together with additional objects and advantages thereof will be best understoof from the following description of specific embodiments when read in connection with the accompanying drawings.

SPECIFIC DESCRIPTION OF PREFERRED EMBODIMENTS

Figure 1:
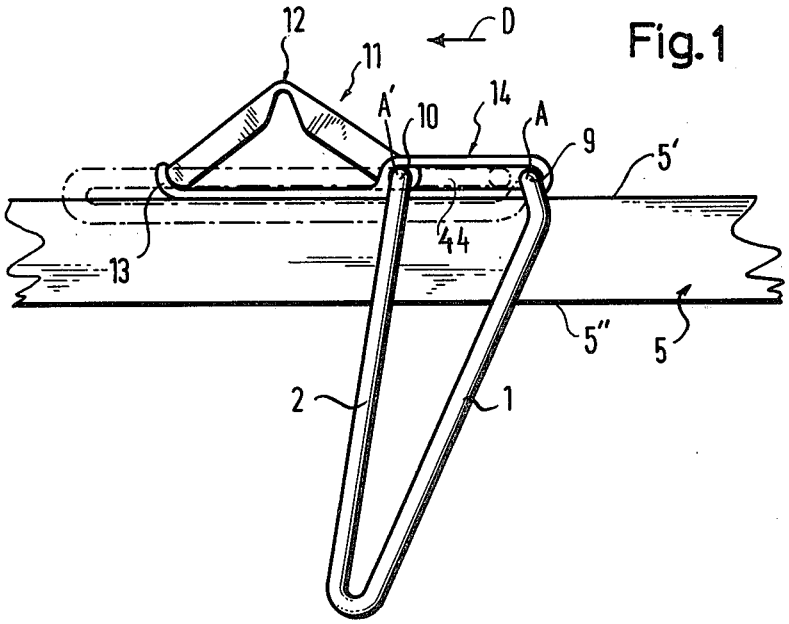
FIG. 1 is a side view of a first embodiment of the present invention.
Figure 2:
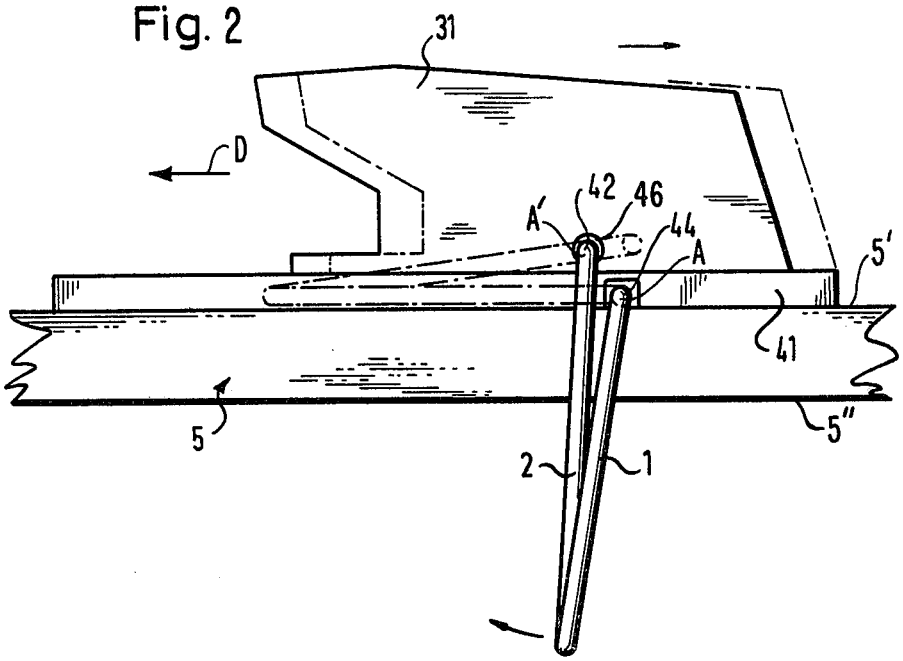
FIG. 2 is a side view of a second embodiment of this invention.
Figure 3:
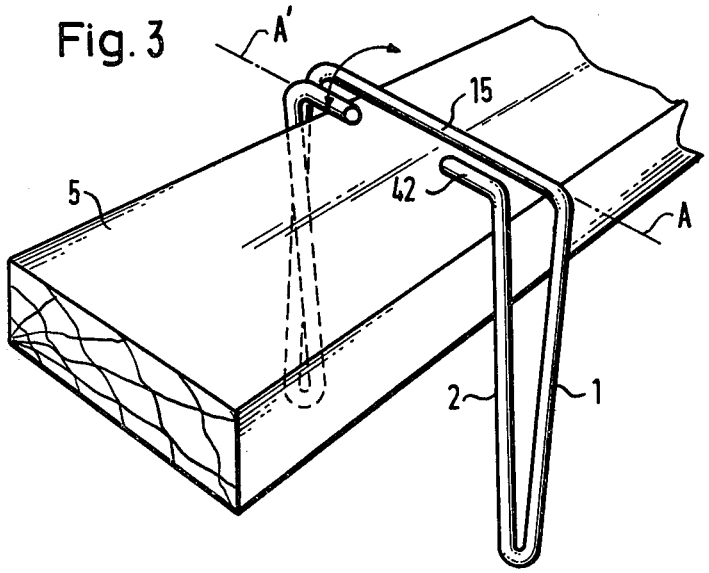
FIG. 3 is a perspective view showing the brake elements of the ski brake of FIG. 2.

As shown in FIGS. 1–3 wherein like reference numerals and letters are used for functionally identical structure, all the ski brakes according to this invention have a pair of brake elements each defined by a pair of legs 1 and 2 one of which is pivoted on a ski 5 about a fixed axis A and the other of which is pivoted about a movable axis A'. The ski 5 has an upper surface 5' which normally carries a ski boot and a lower surface 5'' that normally engages the snow, this ski normally being displaceable in a direction D along the ground or snow. In all embodiments the two legs 1 and 2 are formed of spring-steel wire.

In the arrangement shown in FIG. 1 a mounting plate 14 is provided formed with a slot 44 whose rear end defines the fixed axis A for a bent-over end 9 of the rear leg 1 and whose front end defines a rest position for a bent-over end 10 of the leg 2. This bent-over end 10 defines the movable axis A' and is connected via a two-part actuating member 11 hinged at the middle at 12. The front end of this actuator 11 is braced against an abutment 13 formed on the guide 14. Thus when the actuator is flattened out from the solid-line position shown in FIG. 1 the brake element defined by the legs 1 and 2 will move up into the dot-dash line position. Normally this flattening-out of the element 11 is effected by placing the ski boot on top of the actuator 8 or 11.

In FIGS. 2 and 3 a heel clamp 31 is provided with a guide constituted by a cylindrical recess 46 which receives the bent-over upper end of the leg 2. This heel clamp 31 is slidable on a mounting plate 41 which is fixed on the ski 5 and forms the axis A for the upper end of the leg 1 which is connected via a straight bight 15 to the corresponding leg 1 of the other brake element. As shown also in FIG. 3 the leg 2, which lies in a plane parallel to the direction of displacement of the ski but non-parallel to the plane of the leg 1 has an upper end 42 pivoted at 46 in the heel clamp 31. Thus backward displacement of the heel clamp 41 will automatically displace the brake element formed by the legs 1 and 2 into the dot-dash position shown in FIG. 8.

We claim:

1. A ski brake for use on a ski having a snow-engaging lower surface and a boot-carrying upper surface and normally adapted to travel forwardly in a predetermined travel direction, said ski brake comprising:

a pivot on said ski defining an immovable pivot axis fixed relative to said ski and extending generally parallel to said surfaces and transverse to said direction;

a guide on said ski defining a slidable pivot axis generally parallel to and spaced from said immovable pivot axis and displaceable between an unactuated position relatively far from said immovable pivot axis and an actuated position relatively close to said immovable pivot axis;

a brake element having a guided leg having one end pivoted in said guide at said slidable pivot axis and a pivot leg having one end pivoted in said pivot about said immovable pivot axis, said legs having opposite joined-together ends, said brake element being displaceable between a braking position with said slidable axis in said unactuated position and said legs extending at an acute angle to each other and downwardly below said lower surface and a rest position with said legs extending generally parallel to said direction, lying above said surfaces, and with said slidable axis in said actuated positions;

actuator means including an actuator slidable in said direction on said ski between an advanced position relatively far from said fixed pivot axis and a depressed position relatively close to said fixed pivot axis and spaced from said advanced position for displacing said braking element from said braking into said rest position on displacement from said advanced into said depressed position, said actuator being pivotally connected to said one end of said guided leg; and spring means in said legs for urging same into said braking position, for urging said actuator means into said advanced position, and for urging said slidable pivot axis into said unactuated position.

2. The ski brake defined in claim 1 wherein said slidable axis is above said fixed axis.

3. The ski brake defined in claim 1 wherein each of said legs is a wire.

4. The ski brake defined in claim 1 wherein said spring means is a unitary elbow formed at said other ends of said legs and connecting same.

5. The ski brake defined in claim 1 wherein said guided leg is bent over at its one end and said guide is formed with a slot extending in said direction and receiving the bent-over one end of said quided leg.

6. The ski brake defined in claim 1 wherein said guided leg is bent over at its said one end, said actuator being formed with a laterally opening recess forming said guide and receiving the bent-over one leg of said guide leg.

7. The ski brake defined in claim 6 wherein said ski is provided with a boot clamp forming said actuator.

8. The ski brake defined in claim 1 wherein said legs lie in respective planes both generally parallel to said direction and intersecting generally at said other ends.

9. The ski brake defined in claim 1, further comprising an abutment fixed on said ski and nondisplaceable thereon in said direction, said actuator means having one end part engaged against said abutment and another end part articulated on said one end part said other end part including said actuator pivotally engaging said one end of said guided leg, said actuator means having in said advanced position its said parts extending at an angle to each other upwardly from said upper surface and in said depressed position having its said parts generally in line with each other and generally lying on said upper surface.

10. The ski brake defined in claim 9 wherein said two parts are unitary and hinged together.

* * * * *